US008312661B2

(12) United States Patent
Ludlow

(10) Patent No.: US 8,312,661 B2
(45) Date of Patent: Nov. 20, 2012

(54) FOLDING RIFLE STOCK

(76) Inventor: Christopher Allen Ludlow, Rapid City, SD (US)

( * ) Notice: Subject to any disclaimer, the term of this patent is extended or adjusted under 35 U.S.C. 154(b) by 281 days.

(21) Appl. No.: 12/218,924

(22) Filed: Jul. 18, 2008

(65) Prior Publication Data

US 2012/0137561 A1 Jun. 7, 2012

(51) Int. Cl.
*F41C 23/04* (2006.01)

(52) U.S. Cl. ..... 42/73; 42/75.03

(58) Field of Classification Search ..... 42/71.01, 42/72, 73, 75.01, 75.03, 75.04
See application file for complete search history.

(56) References Cited

U.S. PATENT DOCUMENTS 543,138 A * 7/1895 Murray ..... 42/71.01
1,433,514 A * 10/1922 Porter ..... 42/106
3,369,316 A * 2/1968 Miller ..... 42/72
3,798,819 A 3/1974 Hillberg
4,299,046 A 11/1981 Atchisson
4,579,034 A 4/1986 Holloway
4,691,462 A * 9/1987 Mattarelli ..... 42/75.04
D324,557 S 3/1992 Livingston
5,123,194 A * 6/1992 Mason ..... 42/75.02
6,591,533 B2 * 7/2003 Wygant ..... 42/72
6,598,329 B1 * 7/2003 Alexander ..... 42/71.01
7,673,412 B2 * 3/2010 Griffin ..... 42/73
2009/0266618 A1 * 10/2009 Mitchell et al. ..... 175/325.7

* cited by examiner

*Primary Examiner* — Bret Hayes
*Assistant Examiner* — Reginald Tillman, Jr.
(74) *Attorney, Agent, or Firm* — Bennet K. Langlotz; Langlotz Patent & Trademark Works, Inc.

(57) ABSTRACT

A folding rifle stock has a forward portion for securing to a rifle action having a barrel and trigger. The stock has a rear portion having a shoulder-engagement surface. The forward portion and rear portion are pivotally connected and movable between an extended position and a folded position. The rear portion includes a grip positioned adjacent to a trigger location on the front portion, so that a finger on a user's hand gripping the grip may operate the trigger when the stock is in the extended position. The hinge may be directly connected to a metal bedding block in the front portion. The hinge may be adjustable to take up slack due to wear, with a tapered hinge pin, and with one hinge portion configured to selectable clamp a threaded portion of the hinge pin. The hinge may include a latch to lock the stock in the extended position, and the lock may include a wedging cam element to generate torque to bias the stock to the extended position.

2 Claims, 5 Drawing Sheets

FOLDING RIFLE STOCK

FIELD OF THE INVENTION

This invention relates to the firearms, and more particularly to hinged or folding stocks for rifles.

BACKGROUND AND SUMMARY OF THE INVENTION

Conventional rifles such as bolt-action rifles have stocks that provide a comfortable, ergonomic shoulder rest and gripping surfaces. The stock receives the operating parts of the rifle, which are assembled as a barreled action that is securely attached to and partially enveloped by the stock. Normally stocks are in one piece, to provide rigidity. Flexure of a stock can apply stresses and pressure to the action or barrel, impairing accuracy.

Folding stocks are employed to make a rifle more compact for storage, transport, and for use in close quarters where a full length stocked rifle would be unwieldy. Such stocks are well known on military rifles, which normally have a protruding pistol grip. Other folding stock rifles have thumbhole stocks that have a handgrip for the trigger hand, but which is connected at the lower end of the handgrip to the rear portion of the stock to provide a non-military appearance while still providing essentially the same handgrip position.

Folding stocks normally have a rear portion that is hinged to the forward portion. The forward portion (which may be on one or more parts) supports the barreled action. The forward portion typically includes a "forearm" extending beneath the barrel for gripping by the support (non-trigger) hand. The forward portion normally includes any grip for the trigger hand, which allows the rifle to be controllably fired when the rear portion of the stock is folded. If the grip were on the rear portion, utility of the rifle might be assumed to be reduced when the stock is folded. This might be considered undesirable for military use where a stock is folded in close quarters, or when a stowed rifle needs to be rapidly brought into action, such as by a paratrooper who jumps with a folded stock for safety reasons.

A further disadvantage of existing folding stocks is that the folding mechanism is subject to loosening from wear, or otherwise introduces flexibility or movement that can impair accuracy. In some environments, debris can impair operation of the mechanism as well.

The present invention overcomes the limitations of the prior art by providing a folding rifle stock. The stock has a forward portion for securing to a rifle action having a barrel and trigger. The stock has a rear portion having a shoulder-engagement surface. The forward portion and rear portion are pivotally connected and movable between an extended position and a folded position. The rear portion includes a grip positioned adjacent to a trigger location on the front portion, so that a finger on a user's hand gripping the grip may operate the trigger when the stock is in the extended position. The hinge may be directly connected to a metal bedding block in the front portion. The hinge may be adjustable to take up slack due to wear, with a tapered hinge pin, and with one hinge portion configured to selectable clamp a threaded portion of the hinge pin. The hinge may include a latch to lock the stock in the extended position, and the lock may include a wedging cam element to generate torque to bias the stock to the extended position.

DETAILED DESCRIPTION OF A PREFERRED EMBODIMENT

Figure 1:
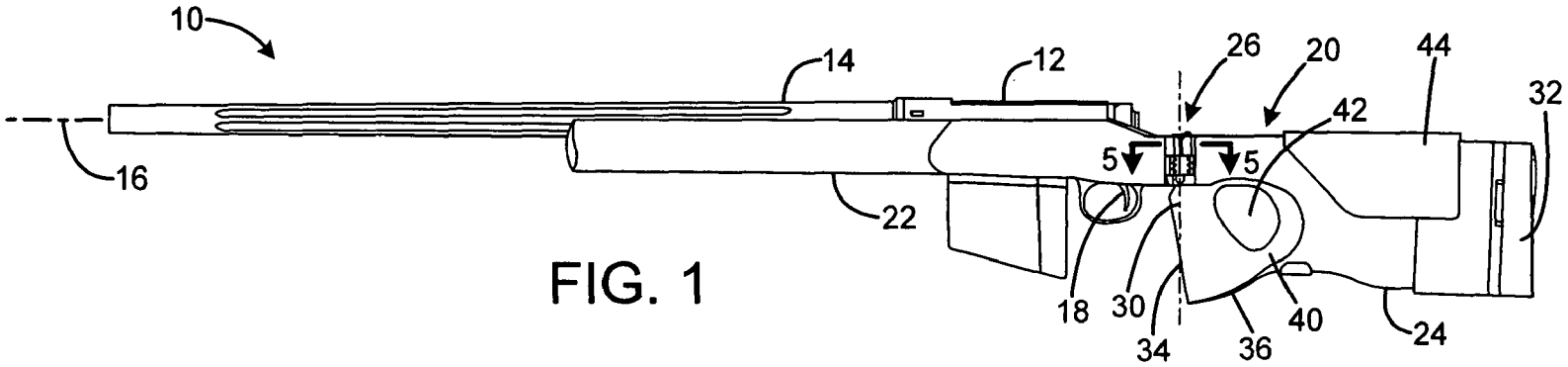
FIG. 1 is side view of a firearm including a stock according to a preferred embodiment of the invention.

FIG. 1 shows a rifle 10 having an action 12 with an extending barrel 14 defining a bore axis 16. A trigger 18 extends downward from the action near the rear. While shown as a conventional bolt action rifle, alternative embodiments may include any other type of conventional or novel firearm action.

A folding stock 20 according to the present invention has a forward portion 22 secured to the action 12, and extending below a portion of the barrel. A rear stock portion 24 is connected to the forward portion by a hinge assembly 26 defining a vertical pivot axis 30. The rear portion has a butt pad surface 32 at the rear for engaging a user's shoulder for aiming and firing the rifle.

The rear portion has a grip 34 near the hinge at the forward portion of the rear portion of the stock. The grip extends downward and slightly rearward from the hinge, at an angle common to pistol grips. The grip is intended for grasping by the user's dominant hand that will be used to pull the trigger when the hand is in position on the grip. The lower end 36 of the grip is shown connected by a span 40 to the major body portion of the rear stock portion, defining a thumbhole 42 for passage of the user's grip hand thumb. In alternative embodiments, the grip may protrude freely without a span, in the manner of conventional pistol grip stocks. The rear portion has an adjustable cheek rest 44, and may include any other desired features known to conventional non-folding rifle stocks.

Figure 2:
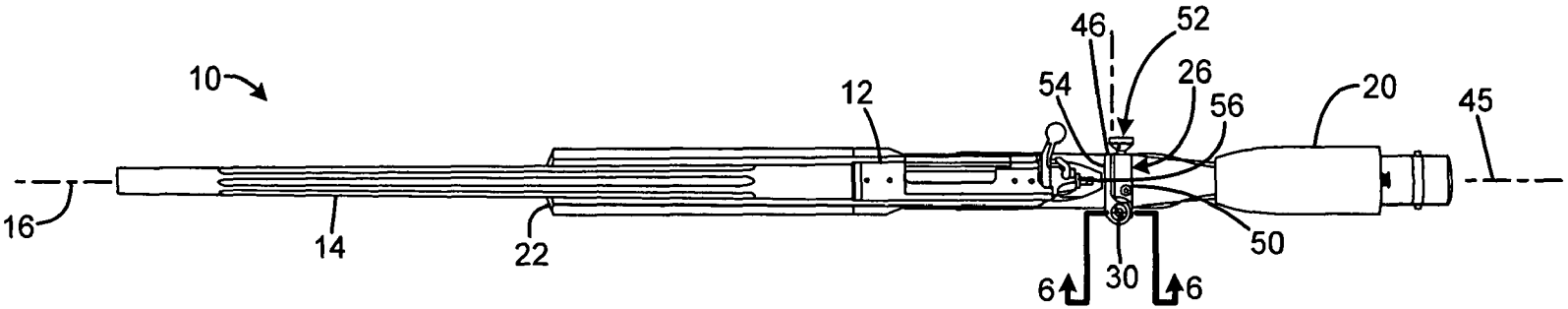
FIG. 2 is a top view of the embodiment of FIG. 1 with the stock in an extended position.
Figure 3:
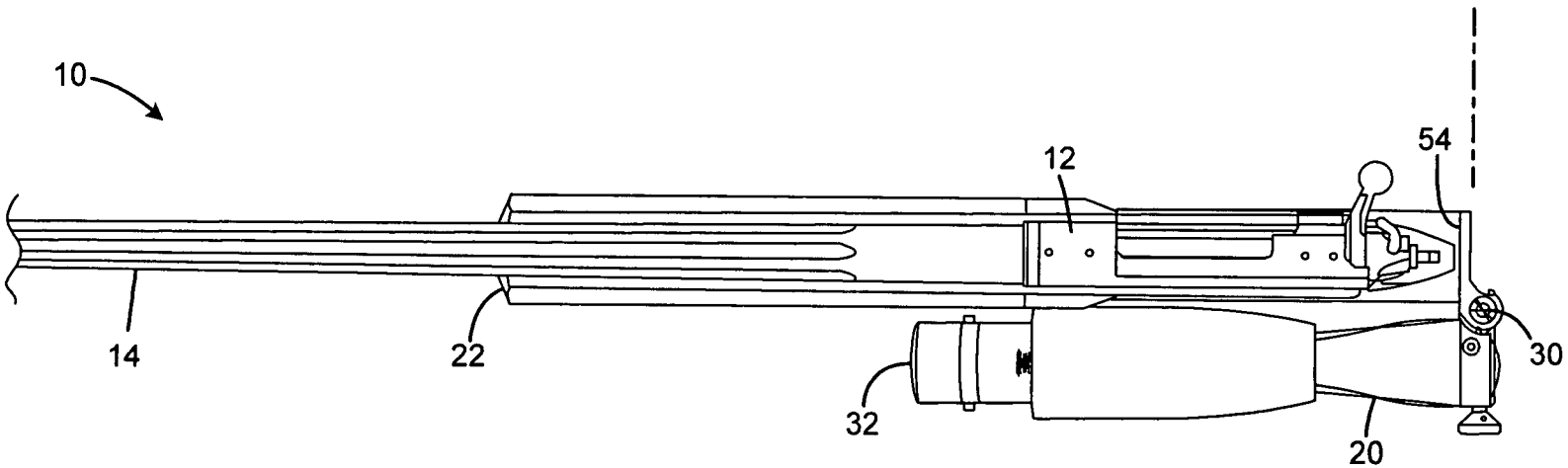
FIG. 3 is a top view of the embodiment of FIG. 1 with the stock in a folded position.

FIG. 2 shows the rifle from above in an extended position in which the length of the stock defines a stock axis 45 parallel to the bore axis 16. The hinge assembly includes a forward hinge element 46 connected as the rearmost part of the forward stock portion 22, and a rear hinge element 50 connected as the forwardmost part of the rear stock portion. The rear hinge element includes a laterally protruding locking knob 52 that operates to secure the stock in the extended position shown. The front hinge element has a front surface 54, and the action 12 has a rear end 56 that nearly abuts the surface 54, and is nominally spaced apart by 0.087 inch in the preferred embodiment, with this spacing being only to accommodate manufacturing variations of different actions to be received by the stock. In alternative embodiments, the action may abut the plate surface, or may overlap the plate, with the plate being suitably formed to pass the rearmost portion of the action. Thus, when the stock is folded, the hinge mechanism adds only minimally to the length of the barreled action, minimizing storage size FIG. 3 shows the stock in a folded condition. The rear portion has been pivoted about axis 30 by 180 degrees. The front and rear stock portions abut each other in a side-by side relationship. The pivoting rear stock includes the grip, which is now laterally offset from the trigger and midline of the action by about 2¼ inches, while the major axes of the forward and rear stock portions are parallel.

Figure 4:
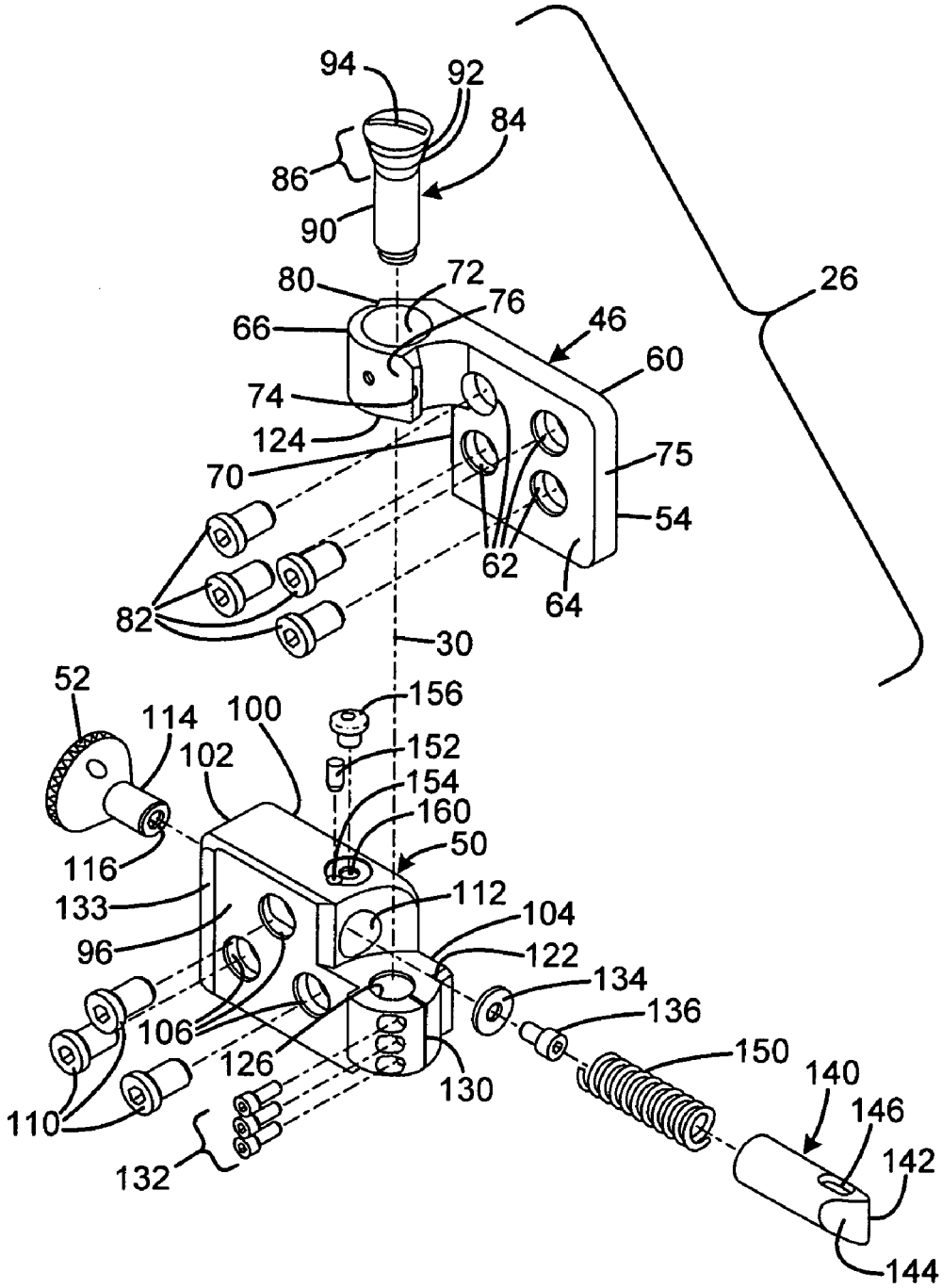
FIG. 4 is an exploded view of the hinge mechanism of the embodiment of FIG. 1.

FIG. 4 shows an exploded view of the hinge assembly 26. The front hinge element is a solid steel element machined as a single piece. A flat plate 60 has a rectangular shape defining four chamfered screw holes 62. The plate 60 has a rear face 64 facing opposite the front surface 54. At an upper portion of the left edge of the plate as viewed from the rear, an upper hinge knuckle 66 extends laterally from the left edge 70 of the plate. The knuckle extends rearward from the front surface 54, and defines a smooth-surfaced bore 72 that includes a tapered upper portion that will be discussed in greater detail below. The bore defines the hinge axis 30. The exterior of the knuckle is essentially cylindrical, with a first ridge 74 facing in the direction of the plate's right edge 75, and having an angled cam surface 76 that extends parallel to the axis 30, and is angularly offset from the plane of the plate as will be discussed in greater detail below. A similar feature 80 is formed on the opposite side of the knuckle.

Four flat-head screws 82 having threaded shanks pass through the holes 62, for engaging the front portion of the stock. A hinge screw 84 has a gently tapered upper portion 86 and a threaded shank 90. The upper portion has a taper angle of 15 degrees offset from parallel to the axis 30, and mates with the bore 72, which has the same taper angle for full contact between the respective surfaces. The tapered portion defines two circumferential grooves 92 that retain grease or other lubricant. The head of the hinge screw defines a slot 94 for receiving a screwdriver.

The rear hinge element 50 is a solid steel element machined as a single piece. It is a generally rectangular block or thick plate. The rear element has a front surface 96, a rear surface 100, a right side edge 102 (as viewed from the rear when in the extended position) and an opposed hinge knuckle 104, which extends laterally from the lower half of the plate. Three screw holes 106 penetrate the plate perpendicular to the major plane, and have substantial counterbores to receive screws 110 in a deeply recessed position. A lateral bore 112 extends laterally through the width of the upper portion of the plate, at a level above the knuckle 104. The bore 112 has a threaded portion (not shown in this view) at the right edge 102 for receiving the threaded shank 114 of the locking knob 52, which defines a small threaded bore 116 at the free end. The remainder of the bore 112 is smooth, and is larger than the threaded portion to provide a shoulder 120 as shown in FIG. 5.

Returning to FIG. 4, the knuckle 104 of the lower portion has a flat upper surface 122 that is intended to abut the flat lower surface 124 of the other knuckle 66. The knuckle defines a threaded bore 126 on the pivot axis 30. The bore 126 receives the threaded shank 90 of the hinge screw 84. To secure the screw in position, the knuckle is vertically split by a slit 130 that extends from the outer surface into the bore. This provides two opposed sides of the knuckle, with the sides bored and threaded as will be discussed below to accept clamping screws 132 for clamping the screw in position. A raised ridge 133 is provided on the front surface 96 along the vertical edge away from the knuckle 104. This provides a positive line of contact between the hinge elements when in the closed position, and prevents small debris from impairing the stock being secured in the extended position. When debris is present, the raised ridge is easily wiped off to provide solid, positionally consistent contact.

A washer 134 is secured to the locking knob's free end bore 116 by a screw 136 that is installed after the knob is installed into the bore 112. This prevents the knob from being removed, avoiding loss and potential debris accumulation in the bore. A latch piston 140 is a tubular body having a solid wedge or chisel shaped tip 142 having a vertical leading edge with angled faces 144. The latch piston defines an elongated slot 146 passing vertically through a solid portion of the piston near the wedge tip, with the slot aligned with the length of the piston. A major portion of the piston away from the tip is hollow, and open to the end opposite the wedge tip 142. A compression coil spring 150 is sized to be received in the interior of the latch piston, and to bias against the bottom of the piston bore at one end, and against the washer 134 at the other end. To retain the piston in the bore with a limited range of motion, a dowel pin 152 is inserted in a vertical bore 154 that intersects the center of the bore 112. A screw 156 is installed in an adjacent hole 160 so that the head overlaps the hole 154 to capture the pin 152.

Figure 5:
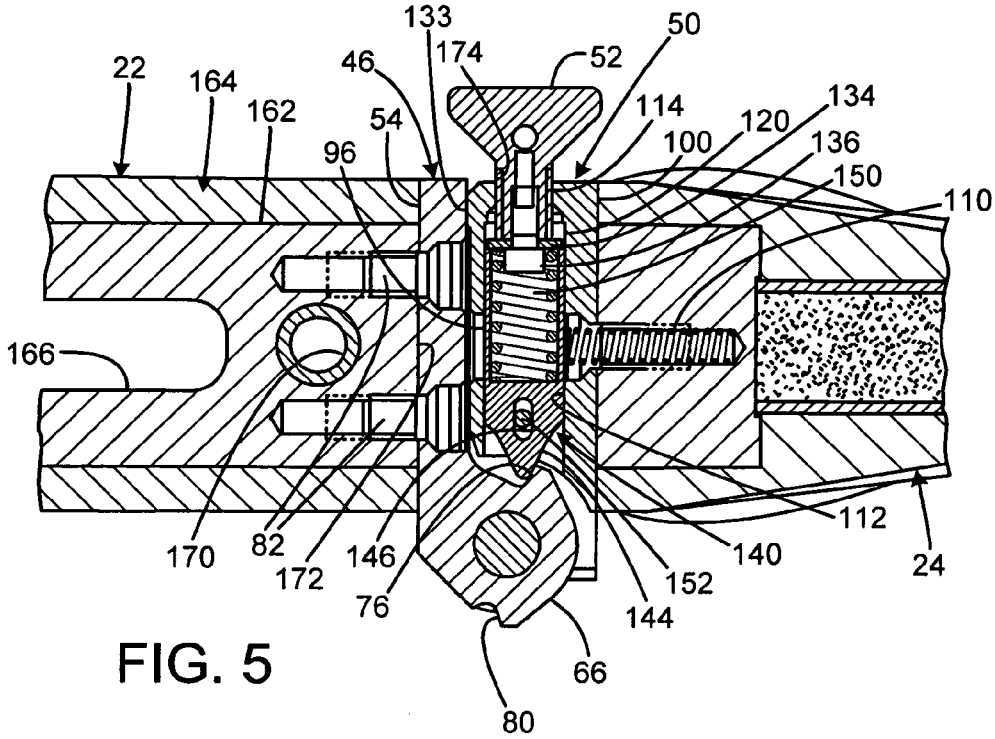
FIG. 5 is an enlarged sectional top view taken along line 5-5 of FIG. 1.

FIG. 5 shows the stock without a barreled action installed. The forward portion 22 of the stock has a solid aluminum bedding block 162 that is embedded within the fiberglass exterior body material 164 of the stock. The bedding block has an opening 166 for the trigger to pass through, and apertures 170 to pass bolts that engage threaded bores on the underside of the action to secure the action to the stock. As in conventional stocks with bedding blocks, the bedding block supports the entire action.

In the preferred embodiment, the bedding block has a flat rear face 172 that is exposed at the rear of the forward stock portion, and forms the majority of the rear surface of the forward stock portion, with the body material surrounding it at the rear surface. This provides for the front surface 54 of the front hinge element 46 to directly abut the bedding block for a substantial area of metal-to-metal contact. The screws 82 provide the clamping between the hinge element and the bedding block, and are threaded into tapped holes in the bedding block. Thus, the forward hinge plate becomes functionally unitary with the bedding block, providing a rigid construction for accuracy. With all four of the screws 82 being positioned near respective corners of the bedding block, the hinge element is secured against bending forces.

FIG. 5 further illustrates the locking mechanism. During assembly, rear hinge element 50 is first secured to the rear stock portion 24 by way of screws 110. The head of illustrated screw 110 is adequately recessed so that it does not protrude into the bore 112 to interfere with piston operation. The lock knob is screwed into the threaded portion 174 of the bore. The washer is secured to the knob tip, so that it will provide a stop against shoulder 120 to prevent knob removal. The spring is inserted into the piston bore, and with the piston is inserted into bore 112. The pin 144 is inserted into the hinge element through the slot 146 to retain the piston.

In this assembled condition, the piston is biased outward against the exterior surface of the knuckle. When the knob is unscrewed and retracted (not shown) the piston will reciprocate into the bore under pressure, such as when the stock position is changed. The wedge tip of the piston will ride over protrusions, acting as a detent. To lock the stock in either the extended or folded position, the knob is screwed in to a locked position (shown). The washer at the tip of the knob solidly presses against the rear rim of the piston, providing rigid support against piston retraction, this forcibly biases the wedge tip against the knuckle.

The contact between piston and knuckle is between the sloped faces (144, 76), which provides a wedging effect to securely resist pivoting of the rear of the stock with respect to the forward portion. It essentially angularly or pivotally biases the stock into the desired position. Even without the knob being locked down, the geometry of the wedge angles and the effect of the spring 150 provides a moderately secure condition in which the stock resists position changes except with deliberate force. This allows emergency use of the stock without the knob being locked down. Locking into the extended position is critical, because a rigid stock is needed for accurate firing. However, to avoid inadvertent extension of the stock, a similar lock element is provided on the opposite side of the knuckle, so that the piston tip can engage the surface 80 and be locked down by the knob to avoid inadvertent extension.

Figure 6:
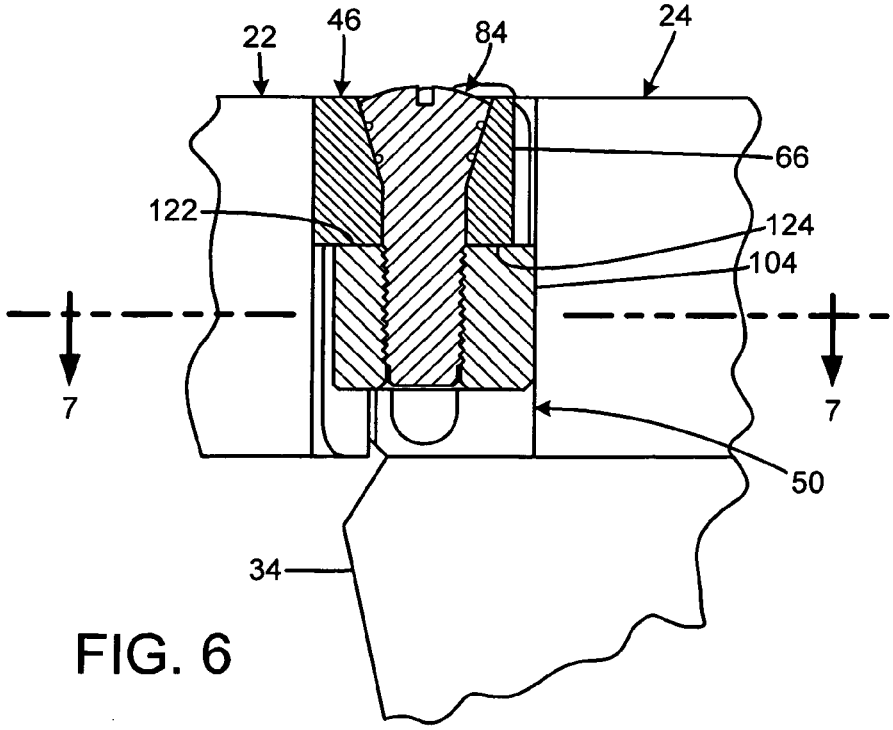
FIG. 6 is an enlarged sectional top view taken along line 6-6 of FIG. 2.

FIG. 6 illustrates the engagement between the knuckles 66, 104. The hinge screw 84 engages the lower knuckle's threaded bore, pressing together the faces 122, 124 of the knuckles. As the faces wear, the pivot screw may be advanced to take up slack and provide a snug connection. This also compensates for wear at the tapered portion of the screw and tapered bore.

Figure 7:
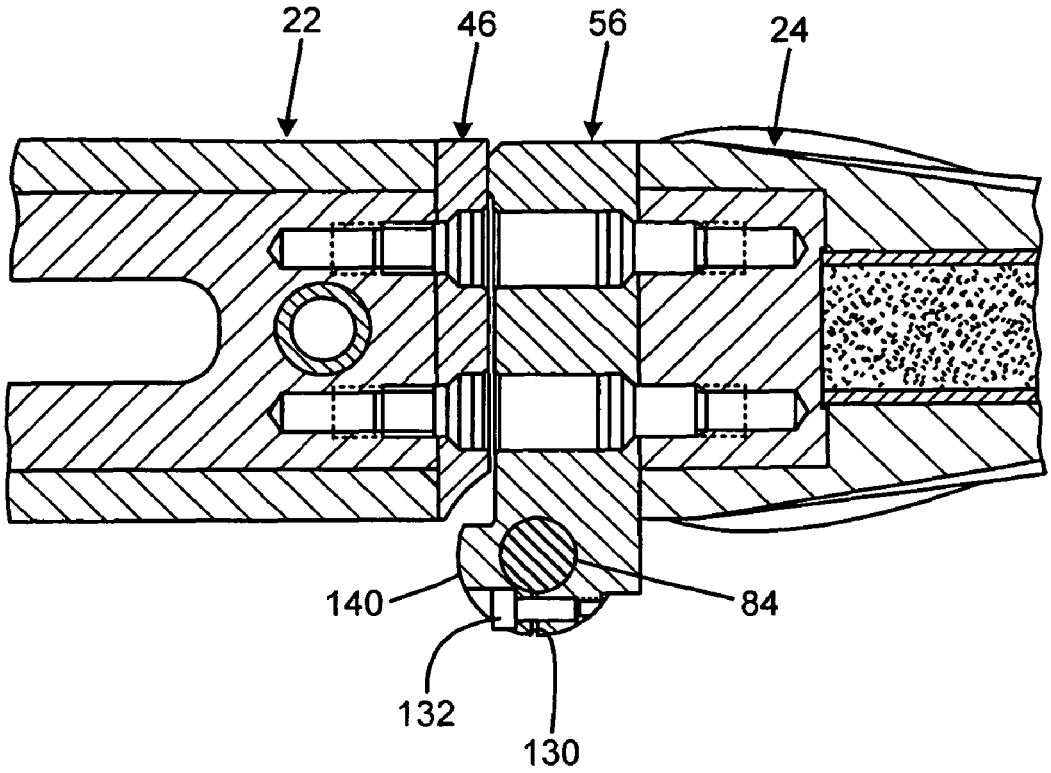
FIG. 7 is an enlarged sectional top view taken along line 7-7 of FIG. 6.

As shown in FIG. 7, the hinge screw 84 is prevented from loosening by the clamping effect of the screws 132 to close the gap 130 in the lower knuckle, clamping the lower shank of the screw in place. This removably fixes the screw to the lower knuckle, so that it provides a rigid hinge pin.

While the above is discussed in terms of preferred and alternative embodiments, the invention is not intended to be so limited.

The invention claimed is:

1. A folding rifle stock comprising:

a forward portion having a facility for securing to a rifle action having a barrel and trigger;

a rear portion having a shoulder-engagement surface;

the forward portion and rear portion being pivotally connected and movable between an extended position and a folded position;

the rear portion including a downwardly-depending grip positioned adjacent to a trigger location on the front portion such that a finger on a user's hand gripping the grip may operate the trigger when the stock is in the extended position; and the grip having a rearwardly-facing palm support surface adapted to support the palm of the user's hand;

wherein a hinge element provides the pivoting function; and wherein the hinge includes a locking mechanism for locking the stock in the extended position, the locking mechanism including a cam surface on one of the front and rear hinge portions, and a movable wedge on the other of the front and rear hinge portions, the movable wedge being movable between an unlocked position in which the wedge is disengaged from the cam surface and the stock is pivotable between the folded and extended positions, and an engaged position, in which the wedge is secured by a threaded element such that rotation of the threaded element secures the wedge in the engaged position such that the wedge forcibly engages the cam to secure the stock in the extended position.

2. A complete operable rifle including the stock or claim 1 with a barreled receiver installed.

* * * * *